United States Patent [19]

Arona-Delonghi

[11] Patent Number: 4,863,300

[45] Date of Patent: Sep. 5, 1989

[54] DISPENSER FOR MATERIALS IN STICK-LIKE FORM

[75] Inventor: Adriano G. Arona-Delonghi, Monterrey, Mexico

[73] Assignee: Fabricacion de Maquinas, S.A., Monterrey, Mexico

[21] Appl. No.: 162,656

[22] Filed: Mar. 1, 1988

[30] Foreign Application Priority Data

Apr. 22, 1987 [MX] Mexico ..... 6148

[51] Int. Cl.[4] ..... A45D 40/06

[52] U.S. Cl. ..... 401/68; 401/75; 401/116; 401/172; 401/79

[58] Field of Search ..... 401/68, 75, 102, 76, 401/116, 172, 79

[56] References Cited

U.S. PATENT DOCUMENTS

| | | | |
|---|---|---|---|
| 700,909 | 5/1902 | Frazer | 401/116 |
| 750,430 | 1/1904 | Brown | 401/116 |
| 1,490,681 | 4/1924 | Stevens | 401/116 |
| 2,815,123 | 12/1957 | Safianoff | 401/78 X |
| 3,191,768 | 6/1965 | Davis | 401/77 X |
| 3,359,992 | 12/1967 | Cishek et al. | 401/102 |

FOREIGN PATENT DOCUMENTS

| | | | |
|---|---|---|---|
| 334391 | 3/1921 | Fed. Rep. of Germany | 401/116 |
| 396084 | 5/1924 | Fed. Rep. of Germany | 401/102 |
| 607560 | 8/1978 | Switzerland | 401/75 |
| 863995 | 3/1961 | United Kingdom | 401/76 |

*Primary Examiner*—Steven A. Bratlie

*Attorney, Agent, or Firm*—Abelman Frayne Rezac & Schwab

[57] ABSTRACT

A dispenser for adhesives and other materials in stick-like form has a main body portion within which a carrier member is threadedly received, and has a closure cap, which, when removed from the main body portion is usable as a drive member for advancing or retracting the carrier member and the material in stick-like form carried thereby.

2 Claims, 3 Drawing Sheets

FIG. 2
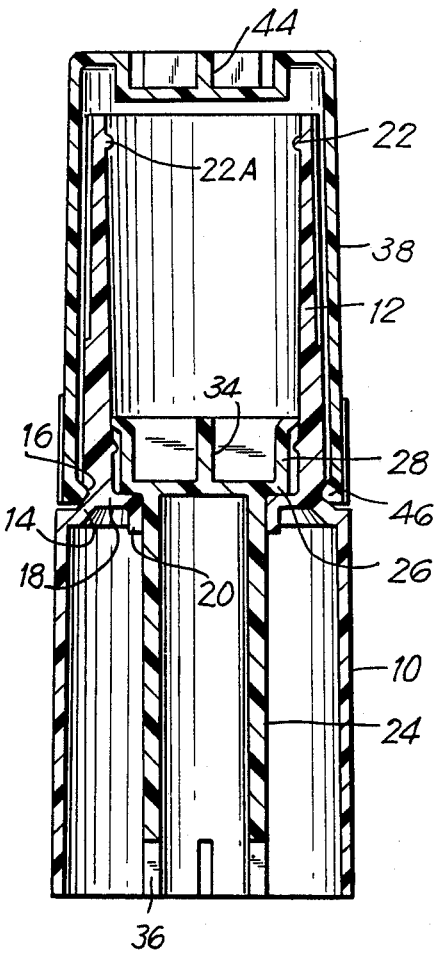
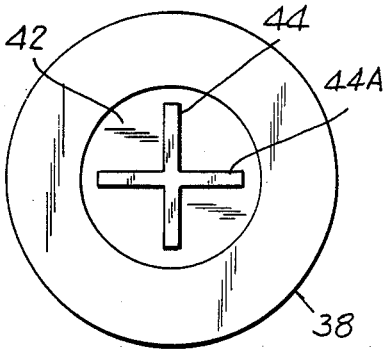
FIG. 3

DISPENSER FOR MATERIALS IN STICK-LIKE FORM

FIELD OF THE INVENTION

This invention relates to a dispenser for adhesive materials or other materials in stick-like form.

BACKGROUND OF THE INVENTION

Dispensers are known that contain adhesive materials in stick-like form.

These dispensers contain an adhesive bar which is advanced in order that the substance can be spread on the surface to be glued.

SUMMARY OF THE INVENTION

It is an object of the present invention to provide a dispenser for adhesives or similar materials having only three components, which is easy to assemble and, which does not require special mechanisms or tools to assemble.

According to the present invention, a dispenser is provided in which an operator for the carrier of the adhesive material is provided by a closure cap of the dispenser.

BRIEF DESCRIPTION OF THE DRAWINGS

FIG. 2 shows the assembled dispenser in cross-section;

FIG. 3 is a plan view of a cap of the dispenser;

DETAILED DESCRIPTION OF THE INVENTION

Figure 1:
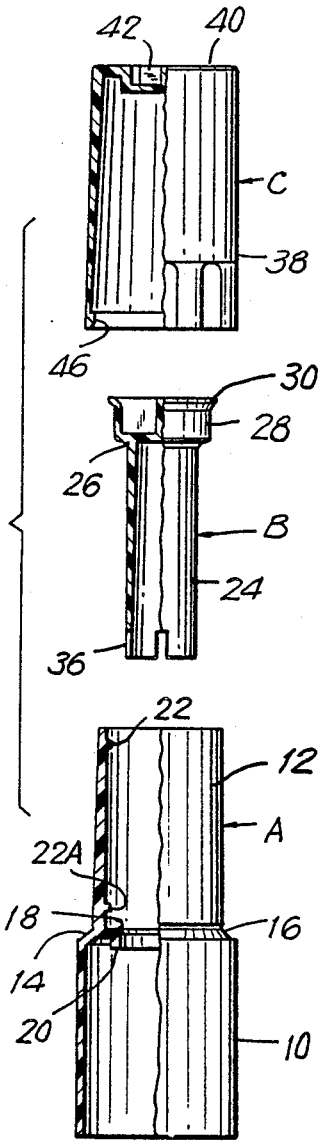
FIG. 1 is an exploded cross-section of the dispenser.

The dispenser of the present invention comprises, in combination, three basic elements, as is described in the following descriptions:

A main body portion A, of plastic material, includes a tubular skirt 10, and a tubular sleeve 12. The tubular skirt 10 is of a greater diameter than that the tubular sleeve 12. Said sections 10 and 12 are joined by a wall 14 providing an external annular groove 16, and an internal annular wall 18. Said annular wall 18 includes a vertical cylindrical guide 20. The tubular sleeve 12 has two internal helicoidal threads 22 and 22A.

A carrier member B includes a tubular member 24 having, at its upper end, a radial wall 26, followed by an upwardly extending cylindrical wall 28 ending in a radial wall 30. Said wall 30 has two slots 32 and 32A, which receive the helicoidal threads 22 and 22A of the main body portion A. Also, said wall 28 has two inner walls 34 and 34A forming a cross-like shape for holding an adhesive bar (not shown).

Figure 4A:
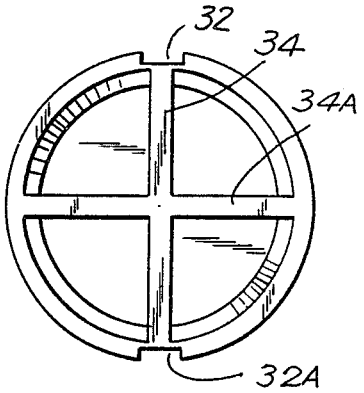
FIGS. 4A and 4B are a plan view and an underside plan view of a carrier for the adhesive material.
Figure 4B:
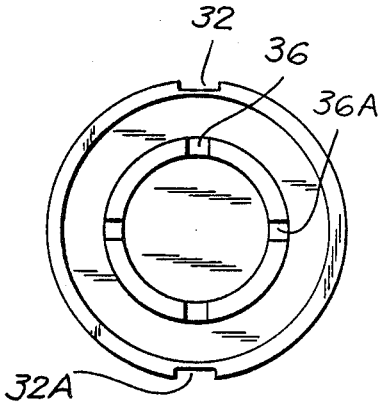

The lower end of the tube 24 has a series of slots 36, arranged at 90 degrees (FIG. 4B), for them to coincide in pairs, one in front of the other.

A third element of the dispenser comprises a cap C, having a tubular portion 38, and an end cap 40. Said cap 40 has a circular recess formed internally with walls 44 and 44A (FIG. 3A) forming a cross. The tubular portion 38 has an internal bead 46 coinciding with a groove 16 in structure A, when the dispenser is assembled.

To the assembly of the dispenser of the present invention, firstly, the carrier member B is inserted into the upper part of structure A, with the slots 32 and 32A in coincidence with the helicoidal threads 22 and 22A.

The cap C is then introduced into the skirt 10 of structure A, and its walls 44 and 44A (FIG. 3A) are inserted into the slots 36 in the lower end of the tubular member 24. Once the connection is made, cap C is rotated in order to rotate the lifting device B and lower it on the threads 22 and 22A. Then, once parts A and B have been assembled, the cap C is removed and placed over the tubular sleeve 12, and is held in that position by the bead 46 of cap C, which is received in the annular groove 16 of structure A.

When it is desired to use the dispenser to apply the adhesive to, for example, a sheet of paper, the closure cap C is removed from the structure A. If insufficient of the adhesive is extending above the tubular sleeve 12, the cap C is then re-inserted into the skirt 10 and is employed to raise the carrier member B by rotating the cap C relative to the skirt 10, and in turn rotating the carrier member B relative to the main body portion A. The user thus has the opportunity of raising or lowering the carrier member B to advance or retract the stick of adhesive supported on the carrier member to any desired extent.

Figure 5:
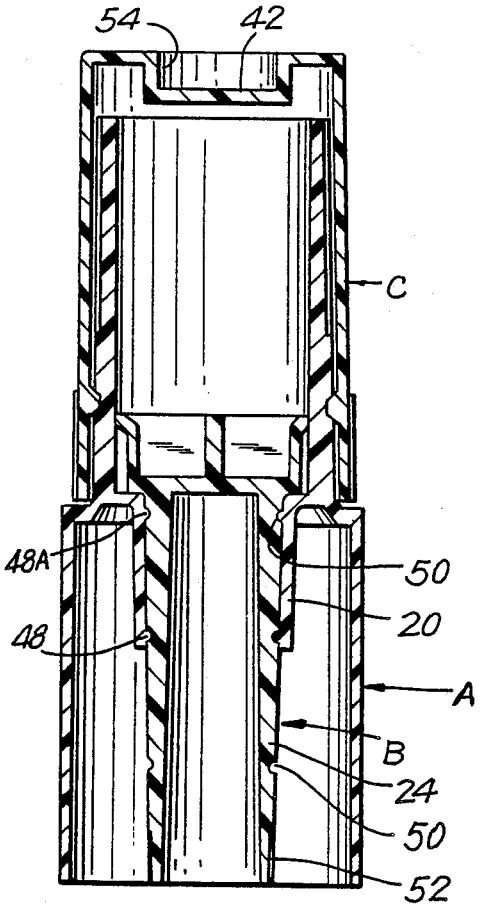
FIG. 5 is a cross section through a second embodiment of the present invention.

Referring now to FIG. 5, a second embodiment of the dispenser of the present invention is shown. In this embodiment, the structure A includes a cylindrical projection 20 having two helicoidal threads 48 and 48A in its interior. Said flanges 48, 48A serve as guides to raise or lower the carrier member.

The tubular member 24 of the lifting device B has a helicoidal thread 50 in its outer periphery. In this manner, a threaded coupling between the carrier member B and the main body portion A is provided by the helicoidal threads 48 and 48A and helicoidal thread 50.

The carrier member 24 includes a fluted section 52 at its lower end.

The cap C has a correspondingly fluted periphery 54 in its recess 42. In this way, the carrier member B can be raised or lowered in the same manner as discussed with reference to FIGS. 1–4B.

I claim:

1. A dispenser for adhesives or other materials in stick-form, comprising:

a main body portion including a tubular sleeve for containing said stick-form material, and a tubular skirt providing an axial continuation of said sleeve of larger internal diameter than the external diameter of said sleeve;

a carrier member positioned within said tubular sleeve and providing an end support for said stick-form material, said carrier member having a cylindrical portion extending into said skirt;

a threaded interconnection between said carrier member and said main body portion for moving said carrier member axially of said main body portion upon relative rotation between said carrier member and said main body portion;

a closure cap removably received over said tubular sleeve, said closure cap being dimensioned for it to be receivable within said tubular skirt of said main body portion, and, cooperating members formed on said cylindrical portion of said carrier member and on one end of said closure cap, whereby, said closure cap when inserted into said tubular skirt is usable as a drive member for rotating said carrier member relative to said main body portion.

2. The dispenser of claim 1, in which said carrier member has external threads threadedly received within threads formed internally of said tubular sleeve.

* * * * *